US006726833B2

(12) United States Patent
Han et al.

(10) Patent No.: US 6,726,833 B2
(45) Date of Patent: Apr. 27, 2004

(54) PROCESS FOR HYDROCONVERTING A HEAVY HYDROCARBON CHARGESTOCK

(75) Inventors: Baoping Han, Liaoning (CN); Lijing Jiang, Liaoning (CN); Youliang Shi, Liaoning (CN); Pai Peng, Liaoning (CN); Mei Jin, Liaoning (CN); Zhaoming Han, Liaoning (CN)

(73) Assignees: China Petroleum & Chemical Corporation, Beijing (CN); Fushun Research Institute of Petroleum & Petrochemicals, SINOPEC Corporation, Liaoning (CN)

( * ) Notice: Subject to any disclaimer, the term of this patent is extended or adjusted under 35 U.S.C. 154(b) by 92 days.

(21) Appl. No.: 10/035,195

(22) Filed: Jan. 4, 2002

(65) Prior Publication Data

US 2003/0006167 A1 Jan. 9, 2003

(30) Foreign Application Priority Data

Jan. 15, 2001 (CN) ..... 01106017

(51) Int. Cl.[7] ..... C10G 47/00

(52) U.S. Cl. ..... 208/108; 208/48; 208/8; 208/10; 208/107; 208/112; 208/216

(58) Field of Search ..... 208/48, 8, 108, 208/107, 112, 216

(56) References Cited

U.S. PATENT DOCUMENTS

| | | | | | |
|---|---|---|---|---|---|
| 4,125,455 | A | * | 11/1978 | Herbstman | 208/108 |
| 4,134,825 | A | * | 1/1979 | Bearden et al. | 208/108 |
| 4,299,685 | A | * | 11/1981 | Khulbe et al. | 208/48 AA |
| 4,999,328 | A | * | 3/1991 | Jain et al. | 502/151 |
| 6,068,758 | A | * | 5/2000 | Strausz | 208/108 |

* cited by examiner

*Primary Examiner*—Walter D. Griffin
*Assistant Examiner*—James Arnold, Jr.
(74) *Attorney, Agent, or Firm*—Birch, Stewart, Kolasch & Birch, LLP

(57) ABSTRACT

The present invention discloses a process for hydroconverting a heavy hydrocarbon chargestock, wherein said chargestock oil is first contacted with a highly active homogeneous hydrogenation catalyst to effect the hydrogenation reaction so that macromolecular radicals of the residue (the precursor of coke) form as less as possible, thereby decreasing the output of coke in the hydrocracking of the residue; when the reaction proceeds to a certain extent, a solid powder is added to adsorb the macromolecular radicals of the residue formed during the reaction and lower their reaction activity, thereby preventing them from further condensing to coke and/or depositing due to polymerization. The synergetic action of the two sorts of substances makes it possible to produce substantively no coke or less coke during the hydrogenation of residue in a suspension bed and prolong the operation lifetime of the unit.

19 Claims, No Drawings

PROCESS FOR HYDROCONVERTING A HEAVY HYDROCARBON CHARGESTOCK

TECHNICAL FIELD

The present invention relates to a process for hydroconverting a heavy hydrocarbon chargestock, in particular, to a novel process for hydrocracking heavy hydrocarbons.

BACKGROUND OF INVENTION

The lightening of heavy oil has become a major task of the refining workers along with the heavier and heavier crude oil and the increasing demand for light oil. Hydroconversion of heavy oil is one of the major processes for the lightening of heavy oils. It not only can largely remove the adverse impurities such as metals, sulfur, nitrogen, etc, but also can crack heavy oil and residue into high value components with low boiling point. Presently, industrialized or industrially mature processes for hydroconversion of heavy and residue comprise four categories: fixed bed, moving bed, fluidized bed and suspension bed, wherein the fixed bed process is more popular and most mature. But this process generally requires operation under higher pressure and lower space velocity, and the catalyst is liable to deactivate when processing poor quality oil, and the catalyst bed is readily to be plugged and the operation cycle is short. Therefore, the fixed bed process is generally used for processing chargestocks containing less carbon residue and metals. Although the moving bed and fluidized bed processes can treat poor quality heavy oil, the investment is higher. The suspension bed process for hydrotreating residue is mainly used in the lightening of poor quality heavy oils. This process has not only a lower operation pressure and a higher space velocity, but also a relatively low investment. Therefore, various large petroleum companies are active in the research and development of the suspension bed hydrogenation process.

All suspension bed hydrogenation processes adopt a fine powder or a liquid homogeneous catalyst (or additive), which is mixed with a chargestock oil and then enters into the reactor together with hydrogen in a mode of upward flow to conduct the hydrocracking reaction. The difference is that the catalysts used therein are different. Most of the early suspension bed hydrogenation technologies use solid powder catalysts. For instance, the VCC process developed by Veba Chemie AG of Germany uses pulverized brown coal or coke as the additive. The related patents U.S. Pat. No. 4,299,685, CA 1276902, U.S. Pat. No. 4,999,328, CN 1035836, and CN 1042174 applied for the CANMET process involve an anti-coking agent, flue dust, coal powder supporting metal salts of Fe, Co, Mo, Zn, etc, coke powder and ferric sulfate, iron-coal paste and ultra-fine ferric sulfate, as used in suspension bed process. The HDH process studied and developed by INTEVEP SA of Venezuela uses the fine powder of natural minerals of Ni and V as the catalyst; the Aurabon process of UOP Inc. uses fine powder of vanadium sulfide as the catalyst, and Chiyoda Inc. applies the industrial waste HDS catalyst powder to the medium-pressure suspension bed hydrogenation of residues. It is well known that the function of the solid powder catalyst (or additive) in the suspension bed process for hydrotreating residues is not to promote the cracking reaction. Bench-scale experiments (K. Kretschmar et. al, Erd Oel und Kohle, 39, 9, 418) show that the liquid yields are similar no matter whether the additive is added or not, and the addition of the additive does not change the yield of $C_1$–$C_4$ gases, but somewhat affects the hydrocarbon distribution. The major function of the additive is to adsorb and hydrotreat in the hydrogen atmosphere the macromolecular radicals (a precursor of coke) formed in hydrocracking to prevent them from further condensing to coke. Meanwhile, the small amount of coke produced during reaction and the metals removed from the asphaltene and resin would also deposit on the additive. In addition, the solid powder catalyst (or additive) can prevent the medium phase from aggregating to large particles. However, the hydrogenation activity of the solid powder catalyst (or additive) is not high due to its low dispersion. Therefore, the unit for suspension bed hydrogenation can not effectively inhibit the coking reaction when operating at a higher conversion, thereby the period of the stable operation is shorter.

In order to enhance the dispersion and hydrogenation activity of the catalyst, various large petroleum companies have started to carry out extensive research and development of the homogeneous catalyst process for hydrotreating residues in the suspension bed since late 1980s. Homogeneous catalysts exist in the form of fine particles of metals or their sulfides during reaction and have high dispersion. Although a small amount of the homogeneous catalyst is added in, the hydrogenation activity is high. The homogeneous catalysts already developed include naphthenates or salts of aliphatic acids as disclosed in U.S. Pat. No. 4,226,742 and U.S. Pat. No. 4,134,825 by Exxon Company, carbonyl metal compounds such as carbonyl cobalt, carbonyl nickel, carbonyl molybdenum, and carbonyl iron as disclosed in CA 2004882, molybdenum or tungsten of $C_7$–$C_{12}$ aliphatic acid as disclosed by Texaco Inc. in U.S. Pat. No. 4,125,455, molybdenum naphthenate combined with cobalt naphthenate as disclosed by IFP in U.S. Pat. No. 4,285,804, water soluble ammonium molybdate catalyst as disclosed in U.S. Pat. No. 4,557,821, U.S. Pat. No. 4,710,486, U.S. Pat. No. 4,762,812, U.S. Pat. No. 4,824,821, U.S. Pat. No. 4,857,496, and U.S. Pat. No. 4,970,190 by Chevron Company. However, the homogeneous catalyst has a rather weak adsorption capacity, and can not prevent the medium phase from aggregating to large particles. The coke formed and the metals removed from asphaltene and resins are liable to deposit and can not be effectively carried out of the unit, resulting in the coking in the reactor, and a shorter period for stable operation.

U.S. Pat. No. 4,066,570 discloses a process for hydrotreating heavy hydrocarbons, wherein two different substances are added during reaction. One is an iron component, which is added in the form of solid particles; the other is an oil soluble metal compound, which is first dissolved in heavy hydrocarbons to be converted into the metal particles with catalytic activity, and then added into the chargestock to effect hydrotreatment together with the ion component. But the final amount of coke is still great, attaining 0.28%, even 0.35%, which therefore would not meet the need of the industrial application.

DISCLOSURE OF THE INVENTION

To solve the aforesaid problems existing in the prior art, the object of the present invention is to provide a process for hydroconverting a heavy hydrocarbon chargestock to produce substantively no coke or less coke in the operation of the suspension bed hydrogenation of residues, thereby prolonging the operation lifetime of the unit.

In order to improve the prior suspension bed process for hydrotreating residues, the present invention provides a multi-stage suspension bed process for hydrotreating residues based on the major functions of two different substances. That is, both a solid powder (a catalyst or an additive) and a homogeneous catalyst (oil soluble or water soluble) are used in the suspension bed process for hydrotreating residues, and they enter the bed reactor from different positions of the reactor so as for them to better exert their respective function.

The embodiment of the present invention is as follows: the homogeneous catalyst (oil soluble or water soluble) is mixed with the heavy hydrocarbon chargestock and hydrogen, and the mixture is pre-heated to a required temperature and is introduced in an upward way into a bed reactor where the hydrocracking reaction takes place. In addition, solid powder is introduced at a position ¼–¾ of the total length from the bottom of the reactor to adsorb the macromolecules produced from the residue in the condensation reaction and carry them out of the reactor.

The homogeneous catalyst used in the present invention comprises all the oil soluble catalysts and the water soluble catalysts suitable for the suspension bed hydrogenation of residues. For example, the oil soluble catalysts comprise the iron-coal paste catalyst prepared by pulverizing an iron compound and coal powder in an oil, and the water soluble catalysts comprise the aqueous solution catalyst of molybdenum phosphate, water soluble catalysts of Mo, Ni, P, and so on. The present invention preferably uses water soluble catalysts. The amount of added homogeneous catalysts is generally 0.01–1.0%, preferably 0.01–0.1% of the total weight of the heavy hydrocarbons chargestock.

The solid powder used in the present invention can be any solid particles that exert substantively no negative effect on the present invention and have powerful adsorption capacity. They preferably meet the following requirements: the pore diameter is no less than 10 nm, preferably no less than 15 nm; at least 50 wt % of the particles have diameters of less than 45 $\mu$m, preferably less than 10 $\mu$m; the amount added is 0.01–4.0% (based on the total weight of the heavy hydrocarbon chargestock fed into the reactor), including the solid catalyst and/or additive. Said solid catalyst may be a Co, Mo, Ni, Zn, K, or Fe catalyst supported on a carrier such as alumina, silica-alumina, activated carbon, or amorphous alumina silicate, or a used hydrogenation catalyst such as a hydrodemetallization, hydrodesulfurization, or hydrodenitrogenation catalyst etc. used in the hydrogenation of heavy oils, or a catalyst for hydrorefining and hydrocracking of other fractions. Said solid additive includes the particles less active or inert for hydrogenation such as brown coal powder, activated carbon, alumina powder, coke products from the coker, and the coke product from the suspension bed unit itself.

Said solid powder is preferably carried into the reactor with a hydrocarbon carrier oil. Said hydrocarbon carrier oil includes the unconverted oil in the product oil of the suspension bed unit, coker gatch, deasphalted oil, poor quality recycle oil (such as heavy oil, clarified oil, or oil slurry), etc. It not only carries the catalyst, but also serves as a quenching oil and enhances the peptizing property of the residue chargestock. The amount to be introduced is determined by the temperature of the reactor and the extent of the reaction. Along with the addition of the hydrocarbon carrier oil and the solid powder, the additional homogeneous catalyst can also be added therewith. Hydrogen can also be made up along with the addition of the solid powder according to the extent of the reaction. It is also permitted that hydrocarbon carrier oil is added, while solid powder is no longer added.

After entering into the reactor, said solid powder comes into contact with the oil gas moving upward to adsorb the macromolecular free radicals of the residue formed in the reaction, preventing them from further condensing to the larger condensed phase, lowering the reactivity of the adsorbed macromolecular free radicals of the residue, and inhibiting the further condensation of the radicals to coke. Of course, said solid powder may be added from several, for example, 1–4 positions simultaneously, depending on the particular situation such as chargestock, reactor, etc. Generally, it is possible to add the solid powder from only one position so as to facilitate the operation and simplify the unit. Besides, the reaction section of the homogeneous catalyst and the reaction section of the solid powder can be realized either in one reactor or in two or more reactors. Where two or more reactors are used, the flow directions of the fluid in the reaction zones may be the same or different.

In the suspension bed reactor(s) of the present invention, the reaction temperature is generally 300–600° C., preferably 400–500° C.; mean liquid hourly volume space velocity is 0.1–2 $h^{-1}$, preferably 0.3–1.5 $h^{-1}$; hydrogen/oil volume ratio is 100–2000, preferably 300–1500; reaction pressure is 6.0–20 MPa, preferably 8.0–15 MPa.

The aforesaid mean liquid hourly volume space velocity means the ratio of the total volume of the liquid chargestock oil fed into the reactor to the volume of the effective reaction section of the reactor.

After leaving the reactor, the mixture of the total oil and gas formed in said conversion reaction of the residue and the porous solid powder with coke enters into a gas-liquid-solid three-phase separator and is effectively separated into a rich hydrogen-containing gas, a liquid oil phase, and a solid catalyst phase.

Said separated hydrogen-containing gas may enter into a gas washing unit, a purification unit, and the purified hydrogen may be recycled back to the reaction system. Said separated liquid oil phase may enter into the downstream refining or converting units for further treatment. The separated solid catalyst phase may return to the reactor directly or after necessary treatments such as coke burning, pulverization, or leave the system for other applications, such as metallurgy, cement, or aluminum production.

The present invention may be applicable to the hydroconversion of the atmosphere residue and vacuum residue, particularly applicable to the hydrotreating of the residue containing large amounts of metals, coke residue, condensed ring compounds, and nitrogen.

Compared to the prior art, the present invention has the following characteristics: by first contacting the chargestock oil with the homogeneous catalyst with a higher hydrogenation activity to conduct the hydrogenation reaction, it is possible for the hydrocarbon chargestock to convert to the macromolecular radicals of the residue (precursor of coke) as little as possible, thereby decreasing the formation of coke in hyrocracking; by adding the solid powder when the reaction proceeds to a certain extent to adsorb the macromolecular radicals of the residue and lower their condensing activity, whereby the coking by condensation and deposit by polymerization are inhibited. Because of the synergetic action of the two categories of substances, no or less coke is formed in the operation of the suspension bed hydrogenation, and the operation lifetime of the unit is prolonged.

EXAMPLES

The present invention is further illustrated with the following examples which should not be construed as limitations of the protection scope of the appending claims.

Comparative Examples 1–5 and Examples 1–4

These experiments are conducted mainly to show the differences among three addition modes of the homogeneous catalyst and solid powder into the suspension bed reactor: 1) they were added respectively together with chargestock (comparative examples 1 to 3); 2) both of them were added together with chargestock (comparative examples 4 to 5); and 3) they were added from different positions according to the present invention (examples 1 to 4). The homogeneous catalyst used in these examples was the one as prepared in Example 9 of CN 1045307C, which was a water soluble catalyst and comprised 5.6 wt % of Mo, 0.7 wt % of Ni, the P/Mo atomic ratio being 0.087, the amount added being 0.05 wt % (based on the total weight of the liquid chargestock) when it was individually added. The solid powder catalyst used in the experiments was desulfurization catalyst ZTS-01 developed by Fushun Research Institute of Petroleum and Petrochemicals and manufactured by First Fertilizer Plant of Qilu Petrochemical Company, which had been used in the fixed bed unit for the hydrogenation of the residue. The physico-chemical properties of the catalyst are shown in Table 1. The particle size of the waste catalyst was 5–15 $\mu$m. The amount was 3 wt % when it was added individually (based on the total weight of the liquid chargestock). The solid powder added in this experiment was amorphous alumina silicate, the physico-chemical properties of it were shown in Table 1. The particle size was 5–15 $\mu$m. The amount was 3 wt % when it was added individually (based on the total weight of the liquid chargestock). The amount of the added homogeneous catalyst was 0.03 wt % and that of the added solid powder was 2.5% (both were based on the total weight of the liquid chargestock) when the two different substances were added. The experiments were all carried out in a suspension bed unit for hydrotreating a residue. The operation conditions and the reaction results are shown in Table 2.

TABLE 1

Physico-chemical properties of the solid powder

| | Amorphous silica-alumina powder | Used ZTS-01 | Analytic method |
|---|---|---|---|
| Probable pore diameter, nm | 12 | 11 | |
| Ni, wt % | | 7.7 | Plasma spectroscopy |
| Mo, wt % | | 15.67 | Plasma spectroscopy |
| V, wt % | | 0.05 | Plasma spectroscopy |
| C, wt % | | 17.20 | C—H—O/N fast analysis method |
| S, wt % | | 6.62 | Tubular furnace method (GB387-64) |

TABLE 2

Operation Conditions and Results of the Reaction

| Comp. Ex. and Ex. Nos. Catalyst | Comp. Ex. 1 Homogeneous catalyst | | Comp. Ex. 2 Used ZTS-01 | | Comp. Ex. 3 Amorphous silica-alumina powder | | Comp. Ex. 4 Homogeneous catalyst and Used ZTS-01 | |
|---|---|---|---|---|---|---|---|---|
| Reaction temperature, ° C. | 410 | 430 | 410 | 430 | 410 | 430 | 410 | 430 |
| Space velocity, $h^{-1}$ | 1.0 | 1.0 | 1.0 | 1.0 | 1.0 | 1.0 | 1.0 | 1.0 |
| Hydrogen pressure, MPa | 8.0 | 10.0 | 8.0 | 10.0 | 8.0 | 10.0 | 8.0 | 10.0 |
| Hydrogen/oil ratio, v/v | 800 | 800 | 800 | 800 | 800 | 800 | 800 | 800 |
| Reaction results | | | | | | | | |
| Coke in product oil, wt % | 0.43 | 0.35 | 0.37 | 0.29 | 0.41 | 0.33 | 0.32 | 0.25 |
| Yield of AGO, % | 28.2 | 34.2 | 30.5 | 37.8 | 32.5 | 39.3 | 30.1 | 37.2 |
| Yield of VGO, % | 31.1 | 36.7 | 29.1 | 33.2 | 28.3 | 31.8 | 32.2 | 35.8 |

| Comp. Ex. and Ex. No. Catalyst | Comp. Ex. 5 Homogeneous catalyst and amorphous aluminum silicate powder | |
|---|---|---|
| Reaction temperature, ° C. | 410 | 430 |
| Space velocity, $h^{-1}$ | 1.0 | 1.0 |
| Hydrogen pressure, MPa | 8.0 | 10.0 |
| Hydrogen/oil ratio, v/v | 800 | 800 |
| Reaction results | | |
| Coke formed, wt % | 0.39 | 0.30 |
| Yield of AGO, % | 30.4 | 37.2 |
| Yield of VGO, % | 30.4 | 34.7 |

| Ex. Nos. | Homogeneous catalyst and solid powder added at different positions of the reaction section | | | |
|---|---|---|---|---|
| Catalyst | Ex. 1 | Ex. 2 | Ex. 3 | Ex. 4 |
| Reaction temperature, ° C. | 410 | 430 | 450 | 460 |
| Space velocity, $h^{-1}$ | 1.0 | 1.0 | 1.2 | 1.5 |
| Hydrogen pressure, MPa | 8.0 | 10.0 | 14.0 | 15.0 |
| Hydrogen/oil ratio, v/v | 800 | 800 | 1000 | 1200 |
| Inlet position of solid powder | 1/4 | 1/2 | 3/4 | 3/4 |
| Amount of solid powder | 0.1 | 0.5 | 1.0 | 1.2 |
| Reaction results | | | | |
| Coke formed, wt % | 0.02 | 0.03 | 0.05 | 0.07 |
| Yield of AGO, % | 29.2 | 34.5 | 45.2 | 48.8 |
| Yield of VGO, % | 32.1 | 37.3 | 42.7 | 44.2 |

It can be seen from Table 2 that the coke contents in the product oils are all rather high when the homogeneous catalyst and the porous solid powder are added individually or in combination at a same position. When the homogeneous catalyst and the porous solid powder are added in combination at a same position, the product distribution is similar to that when the porous solid powder is used alone; the contents of light components such as AGO are rather high, and the proportion of the thermal reaction is high, unable to inhibit coke formation either. The data of the examples of the present invention demonstrate that the hydrogenation reaction of the present invention accounts for a larger proportion, and there is less coke accumulation in the product oil. In summary, the present invention can properly solve the problems of large amounts of coke deposit and the short operation cycle involved in the suspension bed unit.

What is claimed is:

1. A process for hydroconverting a heavy hydrocarbon chargestock, which comprises:

feeding in an upward way a mixture of a homogeneous catalyst, a heavy hydrocarbon chargestock and hydrogen which is pre-heated to a required temperature into a reactor to carry out a hydrocracking reaction, and introducing a solid powder at the position ¼ to ¾ of a total length of the reactor from the reactor's bottom so as to adsorb macromolecules of residue formed during the reaction and carry them out of the reactor.

2. The process according to claim 1, wherein said solid powder has a pore diameter no less than 10 nm; and at least 50% of particles have diameters of less than 45 $\mu$m.

3. The process according to claim 2, wherein said solid powder has the pore diameter no less than 15 nm; and at least 50% of the particles have diameters of less than 10 $\mu$m.

4. The process according to claim 1, wherein an amount of said solid powder added is 0.01–4.0 based on the total weight of the heavy hydrocarbon chargestock fed into the reactor.

5. The process according to claim 1, wherein said solid powder comprises a solid catalyst and/or a solid additive.

6. The process according to claim 5, wherein said solid catalyst is Co, Mo, Ni, Zn, K, and/or Fe catalyst supported on a carrier such as alumina, silica-alumina, activated carbon, or amorphous aluminum silicate.

7. The process according to claim 5, wherein said solid additive is a solid particle that is less active or inert for hydrogenation.

8. The process according to claim 7, wherein said solid additive is a brown coal powder, activated carbon, alumina powder, coke product of a coker, and/or coke product of the suspension bed itself.

9. The process according to claim 1, wherein said solid powder is carried into the reactor with a hydrocarbon carrier oil.

10. The process according to claim 9, wherein said hydrocarbon carrier oil comprises the unconverted oil in the oil formed in the suspension bed, coker gatch, deasphalted oil, and/or poor quality recycle oil.

11. The process according to claim 9, wherein additional homogeneous catalyst is fed together with the feeding of the hydrocarbon carrier oil.

12. The process according to claim 1, wherein the conditions for the hydrocracking reaction in said reactor are: temperature 300–600° C., mean liquid hourly volume space velocity 0.1–2 $h^{-1}$, hydrogen/Oil volume ratio 100–2000, pressure 6.0–20 MPa.

13. The process according to claim 1, wherein the conditions for the hydrocracking reaction in said reactor are: temperature of 400–500° C., mean liquid hourly volume space velocity of 0.3–1.5 $h^{-1}$, hydrogen/oil volume ratio of 300–1500, pressure of 8.0–15 MPa.

14. The process according to claim 1, wherein said homogeneous catalyst is one or more selected from the group consisting of oil soluble catalysts and water soluble catalysts, the amount of which is 0.01–1.0% based on the total weight of the heavy hydrocarbon chargestock fed into the reactor.

15. The process according to claim 1, wherein an amount of said homogeneous catalyst is 0.01–0.1% based on the total weight of said heavy hydrocarbon chargestock fed into the reactor.

16. The process according to claim 1, wherein said homogeneous catalyst is a water soluble catalyst.

17. The process according to claim 1, wherein reaction temperature is 410–460° C., space velocity is 1.0–1.5 $h^{-1}$, hydrogen pressure is 8.0–15.0 MPa, hydrogen/oil ratio (v/v) is 800–1200 and an amount of the solid powder is 0.1–1.2% based upon total weight of said heavy hydrocarbon charged stock fed into the reactor.

18. The process according to claim 17 wherein a yield of AGO is 29.2–48.8%.

19. The process according to claim 17 wherein a yield of VGO is 32.1–44.2%.

* * * * *